US005379838A

United States Patent [19]

Wilson et al.

[11] Patent Number: 5,379,838

[45] Date of Patent: * Jan. 10, 1995

[54] APPARATUS FOR CENTRALIZING PIPE IN A WELLBORE

[75] Inventors: Dennis R. Wilson, Ponca City; Wilber R. Moyer, Blackwell; Larry K. Moran, Ponca City, all of Okla.

[73] Assignee: Conoco Inc., Ponca City, Okla.

[ * ] Notice: The portion of the term of this patent subsequent to Jul. 20, 2010 has been disclaimed.

[21] Appl. No.: 51,031

[22] Filed: Apr. 20, 1993

Related U.S. Application Data

[63] Continuation-in-part of Ser. No. 761,210, Sep. 16, 1991, Pat. No. 5,228,518.

[51] Int. Cl.[6] ..... E21B 17/10

[52] U.S. Cl. ..... 166/242; 166/212; 166/241.1

[58] Field of Search ..... 166/242, 241.6, 376, 166/369, 382, 383, 100, 296, 212, 241.1, 55.1, 297, 299; 175/2, 4.53

[56] References Cited

U.S. PATENT DOCUMENTS

| | | | |
|---|---|---|---|
| 1,432,649 | 10/1922 | Wessels . | |
| 2,178,845 | 11/1939 | Baker . | |
| 2,654,435 | 10/1953 | Oliver . | |
| 2,707,997 | 5/1955 | Zandmer et al. | 166/100 X |
| 2,743,781 | 5/1956 | Lane | 166/212 |
| 2,775,304 | 12/1956 | Zandmer | 166/100 |
| 2,855,049 | 10/1958 | Zandmer | 166/100 |
| 2,874,783 | 2/1959 | Haines | 166/212 |
| 2,913,051 | 11/1959 | Lister . | |
| 3,120,268 | 2/1964 | Caldwell | 166/100 |
| 3,131,759 | 5/1964 | De Rochemont | 166/212 |
| 3,245,472 | 4/1966 | Zandmer | 166/100 |
| 3,326,291 | 6/1967 | Zandmer | 166/100 |
| 3,347,317 | 10/1967 | Zandmer | 166/100 |
| 3,358,770 | 12/1967 | Zandmer . | |
| 3,395,758 | 8/1968 | Kelly et al. | 166/100 |
| 3,448,805 | 6/1969 | Brown | 166/212 |
| 3,603,391 | 9/1971 | Yann | 166/212 |
| 3,924,677 | 12/1975 | Prenner et al. | 166/100 |
| 4,157,732 | 6/1979 | Fonner | 166/315 |
| 4,286,662 | 9/1981 | Page, Jr. | 166/317 |
| 4,498,543 | 2/1985 | Pye et al. | 166/376 |

*Primary Examiner*—Hoang C. Dang
*Attorney, Agent, or Firm*—John E. Holder

[57] ABSTRACT

A system for centralizing casing pipe in a wellbore includes lateral pistons in the side wall of the casing string which are movable by force applied to their inner end, from a retracted position within the maximum exterior profile of the casing pipe string to a predetermined extended position which will move the casing pipe string toward a central position in the borehole. Various well operations can be performed using the pistons in addition to the centralizing function. When a predetermined deploying force is applied to the pistons, they are released from their retracted position for movement to a fixed extended position. The deploying force is accurately determined by a simple retaining mechanism involving a snap ring and groove on the pistons.

17 Claims, 3 Drawing Sheets

APPARATUS FOR CENTRALIZING PIPE IN A WELLBORE

BACKGROUND AND SUMMARY OF THE INVENTION

This application is a continuation-in-part of U.S. patent application Ser. No. 761,210 filed Sep. 16, 1991, now U.S. Pat. No. 5,228,518 issued Jul. 20, 1993.

FIELD OF THE INVENTION

This invention relates to centralizing pipes away from the sides of a wellbore and more particularly to centralizing pipes such as well casing in a borehole utilized in recovering fluids from earth formations.

BACKGROUND OF THE INVENTION

In the process of establishing an oil or gas well, the well is typically provided with an arrangement for selectively excluding fluid communication with certain zones in the formation to avoid communication with undesirable fluids. A typical method of controlling the zones with which the well is in fluid communication is by running well casing down into the well and then sealing the annulus between the exterior of the casing and the walls of the wellbore with cement. Thereafter the well casing and cement may be perforated at preselected locations by a perforating gun or the like to establish fluid communication with product bearing zones in the formation. The cement also prevents the fluids in adjacent zones which are otherwise sealed from the zone of interest by a shale, a fault, or other geological condition from bypassing the geological seal by moving along the wellbore or well casing. Unfortunately, if the casing is not centered in the wellbore and is in contact with the walls of the wellbore, those portions of the casing string do not get surrounded by cement and thus do not seal the wellbore from migrating fluids. It may be desirable for other reasons to center a pipe string or otherwise space a pipe string from the walls of a borehole such as to facilitate perforating into the borehole.

A number of devices, which are typically called centralizers, have been developed to space the pipe string from the walls of the wellbore. An example of a typical centralizer is a bow spring centralizer which comprises a plurality of elongate spring metal strips which bow outwardly from the pipe string. The bow springs are typically provided at the collars of the well casing in sets to push the casing away from the walls of the wellbore. However, during installation of the string into the wellbore the bow springs create substantial frictional forces reducing the potential reach of a well. Also, the bow springs are somewhat fragile and subject to failure.

Another example of a centralizer for cementing operations is U.S. Pat. No. 2,654,435 issued on Oct. 6, 1953 to Oliver. The Oliver device comprises a shoe attached to the end of the casing string wherein the shoe includes bow springs which are held in a collapsed position by a stem extending through the wall of the shoe to an interior retainer. When the string is in the desired position in the wellbore, the casing string is pressurized to force a plug from an aperture in the end of the shoe. The plug is connected to the retainer which releases from the stem when the plug is forced from the aperture which releases the bow springs to centralize the casing. As an alternative arrangement two or more shoes could be installed in the same string with the retainers connected along a shaft to the end plug. Clearly, this system comprises a complicated deployment apparatus which may be subject to failure or premature deployment. Moreover, it would be impractical for a large number of centralizing shoes to be installed in a casing string which may be necessary in a horizontal well since it must rely on the one plug.

A series of patents has issued to Zandemer and others which involve sleeves extendable by hydraulic force to provide a conduit between the borehole wall and a casing or the like. These sleeves may be extended prior to cementing and then typically have portions that are dissolved by acid or the like after the cement is set to provide a flow path from earth formations into a pipe. These patents include U.S. Pat. Nos. 2,707,947; 2,855,049; 3,326,291; 3,347,313, 3,358,770, 2,775,304, 3,347,317 to Zandemer; and U.S. Pat. No. 3,924,677 to Prenner et al. The devices shown in these patents have various drawbacks that render them unacceptable for the situation presented in this application. For example, these devices do not provide a centralizer that will actually force the pipe to the center of the hole, but for the most part, the sleeves are extended until they engage the borehole and at that point they are locked in place. In most cases, nothing insures that each sleeve will extend to a fixed predetermined position. In addition, these devices for the most part do not have pistons with an outer end that resides within the maximum exterior profile of the pipe string. In addition, many of these devices also do not leave a full opening in the casing string when the sleeves are extended to allow devices to be run through the pipe string.

Accordingly, it is an object of the present invention to provide a new and improved method and apparatus for centralizing pipes in a wellbore which overcomes or avoids the above noted limitations and disadvantages of the prior art.

It is a further object of the present invention to provide a method and apparatus for fixedly spacing a pipe string from the walls of a wellbore which includes an extendable piston that remains within the maximum exterior profile of the pipe string while the pipe string is moved into and through the wellbore, including horizontal boreholes, and then is extendable to a predetermined fixed position by the application of a predetermined force to an inner end of the piston which extends into the pipe string while the pipe string is being run into the wellbore.

It is an additional object of the present invention to provide a method and apparatus for spacing a pipe from the walls of a wellbore by using extendable pistons that move when extended to a predetermined fixed position wherein the pistons are clear of the bore of the pipe string when the pistons are extended. The centralizing pistons may subsequently be used for fluid communication between the pipe and the formation, or for facilitating other borehole operations such as perforating, fracturing and treating. The extension force in movement of the pistons to an extended position needs to be accurately determined so that the apparatus is operable in response to a predetermined force.

SUMMARY OF THE INVENTION

The above and other objects and advantages of the present invention have been achieved in the embodiments illustrated herein by the provision of an apparatus comprising a piston for being mounted in an opening in the peripheral wall of the pipe and for extending generally radially outwardly from the pipe to contact the wall of the wellbore and move the pipe away therefrom. A retaining mechanism holds the piston in a retracted position while the pipe is being run into the wellbore. The piston is deployed from the retracted position which is generally within the maximum exterior profile of the pipe to a fixed predetermined extended position wherein the piston extends generally radially from the opening to contact the wall of the wellbore. In the extended position, the piston is substantially clear of the pipe bore to render the pipe full open. Deployment of the pistons results from the generation of a predetermined force which is accurately controlled by a simple latching mechanism such that upon generation of such force the piston is released from a retracted position to an extended position to move the pipe away from the wall of the wellbore. A securing arrangement is provided for securing the piston in the predetermined fixed extended position to hold the pipe away from the wall of the wellbore. The retaining mechanism and the securing arrangement are provided by an interrelated mechanism.

BRIEF DESCRIPTION OF THE DRAWINGS

Some of the objects and advantages of the invention have been stated and others will become apparent as the description proceeds when taken in conjunction with the accompanying drawings in which.

DETAILED DESCRIPTION OF THE PREFERRED EMBODIMENTS

Figure 1:
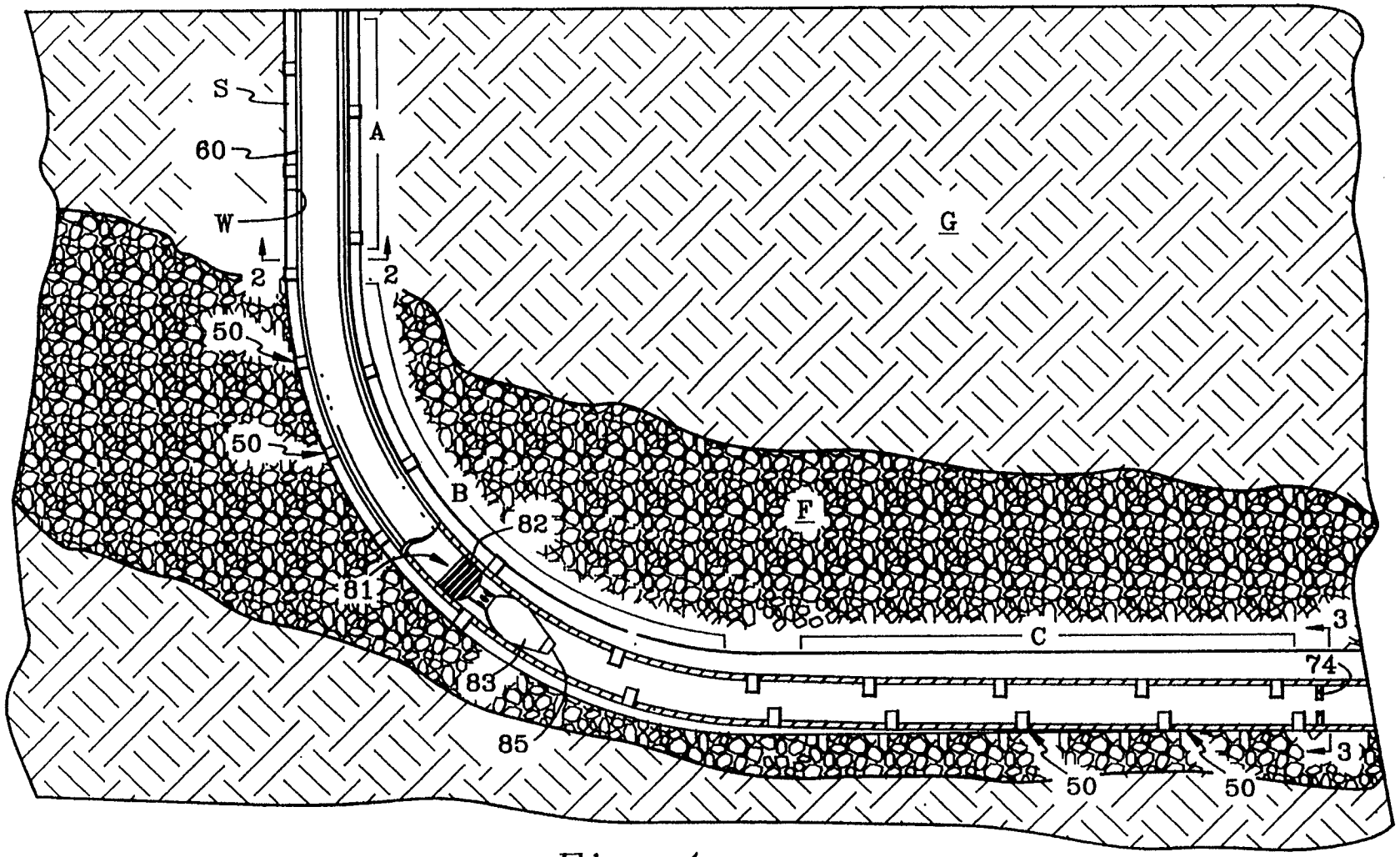
FIG. 1 is a cross sectional view of a wellbore in the ground with a casing string therein spaced from the walls of the wellbore by a plurality of downhole activated centralizers embodying the features of the present invention.

Referring more particularly to the drawings, FIG. 1 illustrates a wellbore W which has been drilled into the ground G. Such wells are often drilled for the exploration and production of hydrocarbons such as oil and gas. The illustrated wellbore W, in particular, includes a generally vertical section A, a radial section B leading to a horizontal section C. The wellbore W has penetrated several formations, one or more of which may be a hydrocarbon bearing zone. Moreover, the wellbore W was particularly drilled to have a horizontal section C which has a long span of contact with a particular zone of interest which may be a hydrocarbon bearing zone. With a long span of contact within a pay zone, it is likely that more of the hydrocarbon present will be produced. Unfortunately, there are adjacent zones which have fluids such as brine that may get into the production stream and thereafter have to be separated from the hydrocarbon fluids and disposed of at additional cost. Accordingly, fluid communication with such zones is preferably avoided.

To avoid such communication with non-product bearing zones, wellbores are typically cased and cemented and thereafter perforated along the pay zones. However, in the highly deviated portions of a wellbore such as the radial section B and the horizontal section C of the illustrated wellbore W, the casing tends to lay against the bottom wall of the wellbore, thereby preventing cement from encircling the casing and leaving a void for such wellbore fluids as brine to travel along the wellbore and enter the casing far from the formation from which it is produced. In the illustrated wellbore W, a casing string or liner 60 has been run therein which is spaced from the walls of the wellbore W by a plurality of downhole activated pistons, generally indicated by the number 50, which serve to centralize the casing. The downhole activated pistons or centralizers 50 are retracted into the casing 60 while it is being run into the wellbore W. Once the casing 60 is suitably positioned in the wellbore W, the centralizers 50 are deployed to project outwardly from the casing as illustrated in FIG. 1. The centralizers 50 move the casing from the walls of the wellbore if the casing 60 is laying against the wall or if the casing is within a predetermined proximity to the wall of the wellbore W. This movement away from the walls of the wellbore will thereby establish an annular free space around the casing 60. The centralizers 50 maintain the spacing between the casing 60 and the walls of other wellbore W while cement is injected into the annular free space to set the casing 60. Thereafter, the well may be managed like any other well. The pistons are latched in an extended position and will thereby maintain the casing 60 centered even if the casing is not cemented as is the case in some completions.

Figure 3:
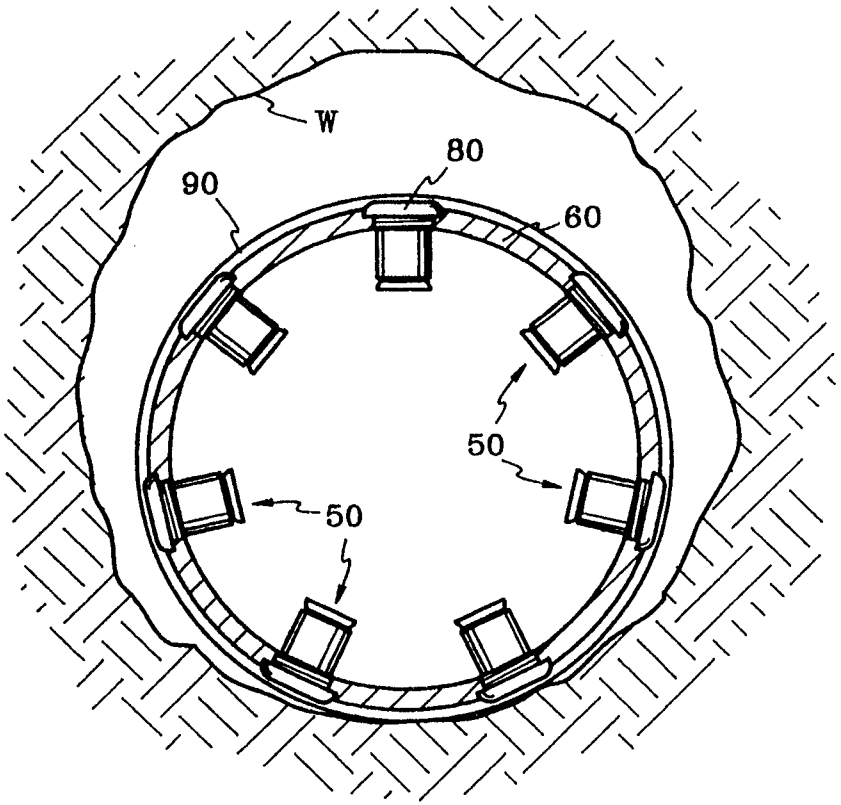
FIG. 3 is a cross sectional end view similar to FIG. 2 prior to the casing being centralized and with the downhole activated centralizers in the retracted position.
Figure 2:
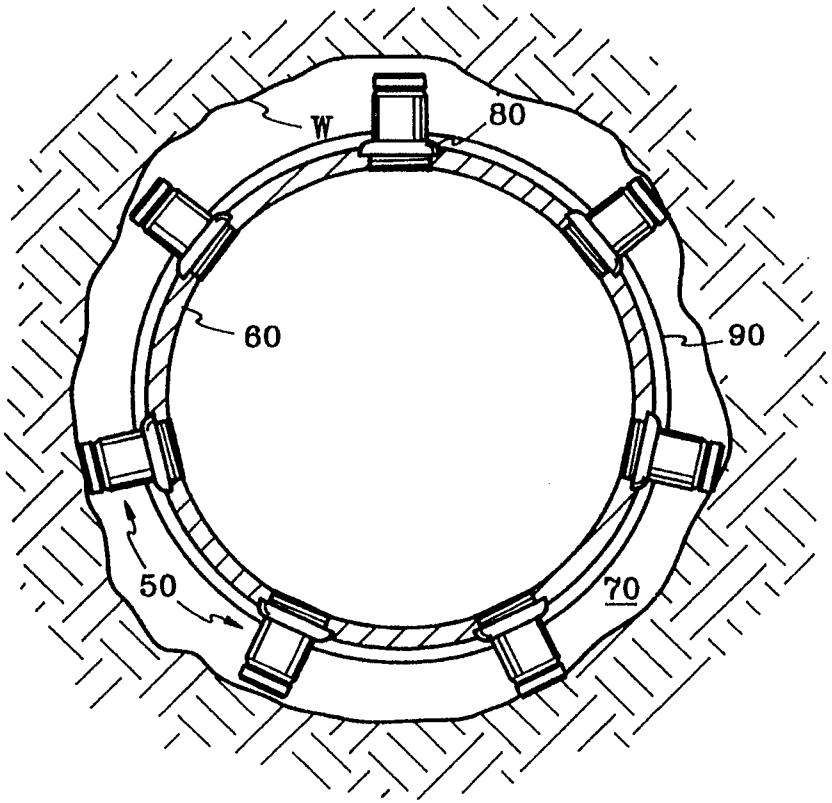
FIG. 2 is an enlarged cross sectional end view of the casing taken along Line 2—2 in FIG. 1.

The centralizers 50 are better illustrated in FIGS. 2 and 3 wherein they are arranged in the extended and retracted positions, respectively. Referring specifically to FIG. 2, seven centralizers 50 are illustrated for supporting the casing 60 away from the walls of the wellbore W, although only four are actually contacting the walls of the wellbore W. It should be recognized and understood that the centralizers work in a cooperative effort to centralize the casing 60 in the wellbore W. The placement of the centralizers 50 in the casing 60 may be arranged in any of a great variety of arrangements. In particular, it is preferred that the centralizers 50 be arranged to project outwardly from all sides of the periphery of the casing 60 so that the casing 60 may be lifted away from the walls of the wellbore W no matter the rotational angle of the casing 60. In some situations it is preferred that the centralizers 50 be regularly spaced along the casing 60 so that the entire length of the casing 60 is centralized. In other situations it is sufficient to center the pipe or casing string at collars or pup joints between pipe sections as will hereinafter be described.

Referring again to FIGS. 2 and 3, the centralizers 50 are mutually spaced around the casing 60 assuring that the orientation of the casing 60 in the wellbore W will not undermine the cumulative effect of the centralizers 50 to centralize the casing 60. As the casing 60 is centralized, an annular space 70 is created around the casing 60 within the wellbore W. The casing 60 is run into the wellbore W with the centralizers 50 retracted as illustrated in FIG. 3, which allows substantial clearance around the casing 60 and permits the casing 60 to follow the bends and turns of the wellbore W. Such bends and turns particularly arise in a highly deviated or horizontal well. With the centralizers 50 retracted, the casing 60 may be rotated and reciprocated to work it into the suitable position within the wellbore. Moreover, the slim dimension of the casing 60 with the centralizers 50 retracted (FIG. 3) may allow it to be run into wellbores that have a narrow dimension or that have narrow fittings or other restrictions.

In FIGS. 2 and 3 and in subsequent Figures as will be explained below, some embodiments of the centralizers 50 present small bulbous portions 80 on the outside of the casing 60 which serve as a means to make the casing wall thicker at that point. It is preferable not to have any dimension projecting out from the casing to minimize drag and potential hangups while moving the string, however as will be discussed below, the bulbous portions 80 are utilized in some embodiments especially in smaller diameter casing such as is often used in horizontal holes when they are cased. It should also be recognized that the bulbous portions 80 are rounded to slide better along the walls of the wellbore W and that the casing string 60 will include collar sections 90 that will extend out radially farther than the bulbous portions (see FIG. 3). Thus, the collar sections 90 present the maximum outer profile of the casing string even when the bulbous portions are present. The outward projection of the retracted centralizers 50 being within the maximum outer profile of the casing string 60 is believed to minimize any problem of running the casing.

Figure 4:
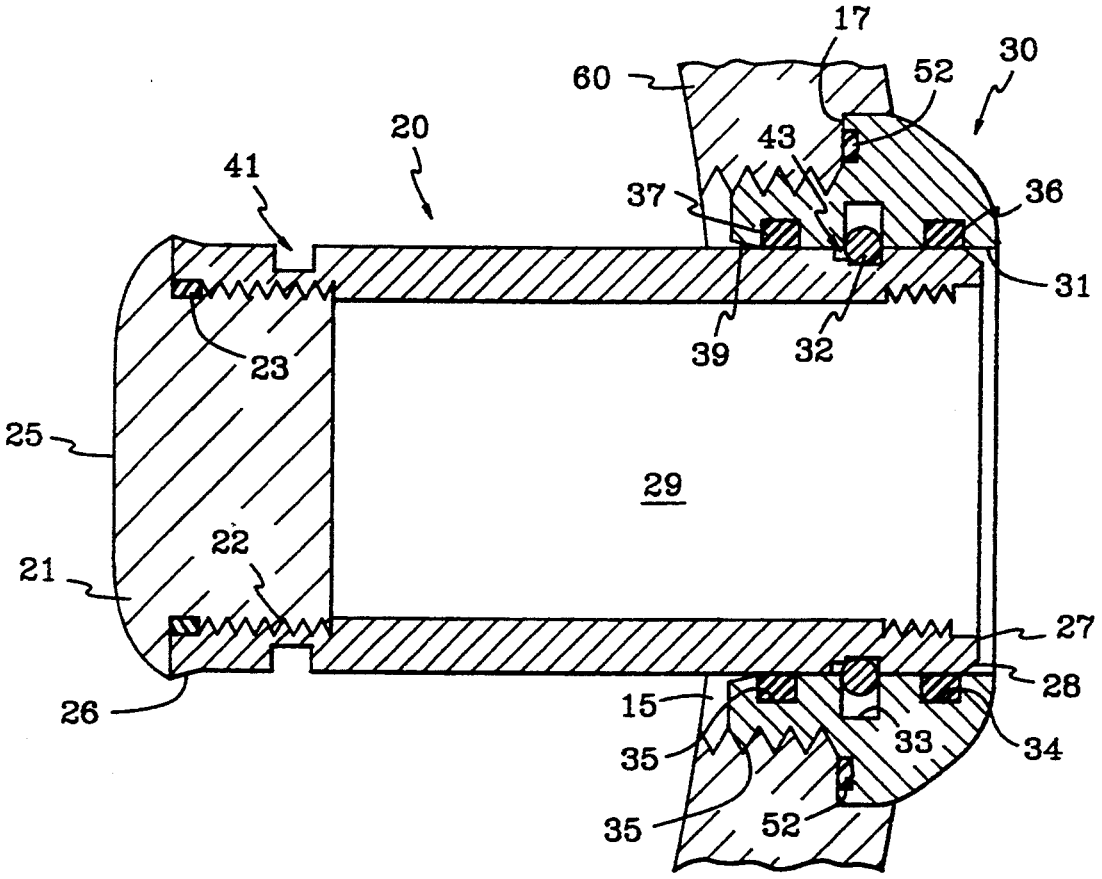
FIG. 4 is an enlarged fragmentary cross sectional view of a downhole activated centralizer mounted in a pipe wall.

The centralizer pistons may take many forms and shapes as is illustrated in Applicant's copending U.S. application Ser. No. 761,210 now U.S. Pat. No. 5,228,518. A centralizer of the present invention is illustrated in FIG. 4 comprising a piston 20 and a piston guide or button 30 mounted in an opening 15 in the casing 60. The piston 20 is a generally cylindrical tube which can be solid or hollow as shown having an internal passageway 29 therein. The piston guide 30 is a slightly larger and shorter tubular element having a hole 31 therein for receiving the piston 20. The piston guide is secured in the opening 15 by screw threads such that it does not extend into the interior of the casing 60 but has a bulbous portion extending outwardly of the casing 60. An O-ring 52 provides a pressure tight seal between the piston guide 30 and the casing 60. In order to accommodate seating of a piston guide comprised of a button 30 in the casing wall, the outer surface of the casing may be spot faced where the hole or opening 15 is formed. An inner face 17 of button 30 then abuts with the spot face. The O-ring 52 is positioned in this face 17.

The piston 20 is arranged for axial movement through the button 30 from a retracted position, in which it is illustrated, to an extended position, such as shown in FIG. 2. The piston 20 and the button or piston guide 30 are mounted in the casing 60 so that their axes are collinear and directed outwardly, preferably radially outwardly, with respect to the axis of the casing 60.

The piston 20 includes a plug 21 secured in the passageway 29 by screw threads 22. The plug 21 shown does not fill the entire passageway 29, but is rather approximately the thickness of the casing 60. Pistons which have other functions may have plugs with a thin wall or no plug. The plug is preferably made of a soft material such as aluminum so that its dome shaped end 25 which faces into the casing bore is deformable under force. An O-ring 23 provides a pressure tight seal between the piston 20 and the plug 21. The piston 20 has the dome shaped inner end 25 and a distal end 27. At the inner end 25, the outer peripheral edge 26 is tapered outwardly, forming the broadest portion of the piston 20. At the distal end 27, the outer peripheral edge 28 is chamfered or tapered inwardly to ease the installation of the piston 20 into the button 30 as will be discussed below.

The piston 20 is slidably mounted in the central hole 31 in the button 30 and is shown retained in a retracted or running position by a snap ring 32. The snap ring 32 is located in a snap ring groove 33 formed in the interior wall of the hole 31 in button 30. If thick walled pipe is used or if the centralizers are positioned in casing collars or special subs having thick walls, the central hole 31 for receiving the piston 20 may be merely a hole in the wall of the pipe. The snap ring groove 33 is then positioned in the peripheral wall of the hole which serves as the piston guide rather than in a guide insert or button 30.

The piston 20 includes two radial piston grooves 41, and 43 formed in the exterior surface thereof. Retaining or running groove 43 is shown in greater detail in FIG. 5. The first of the two piston grooves is a latching or locking groove 41 and is positioned adjacent the inner end 25 to be engaged by the snap ring 32 when the piston 20 is fully extended to the fixed predetermined position, where groove 41 engages snap ring 32 and thereby locks the piston in this fixed position. The other groove on the piston is the running or retaining groove 43 positioned adjacent the distal end 27 to be engaged by the same snap ring 32 when the piston 20 is in the retracted position. Piston 20 is illustrated in FIG. 4 in the retracted position wherein the snap ring 32 is engaged in the radial running groove 43.

The snap ring 32 is made of a strong resilient material to set into the snap ring groove 33 so that its inner periphery extends into the central hole 31 and more particularly into each of the radial grooves 41 and 43 in the outer wall of the piston. The snap ring 32 is resilient as noted above and also has a gap in its peripheral wall so that it can be deflected deep into the snap ring groove 33 to slide along the exterior of piston 20 and allow the piston 20 to move from the retracted position to the extended position. The snap ring 32 must also be strong to prevent the piston 20 from moving unless a sufficient activation force is imposed on the piston 20 to deflect the snap ring 32 out of the radial running groove 43 and deep into the snap ring groove 33.

Figure 5:
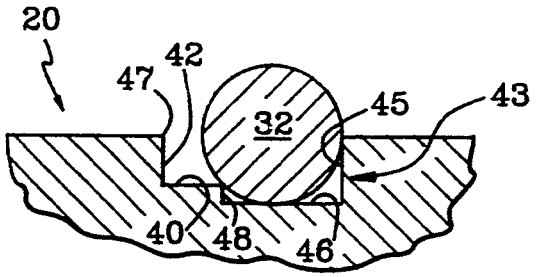
FIG. 5 is a detailed view of a snap ring groove used in the downhole activated centralizer for serving as a retaining mechanism in accordance with the present invention.

Referring to FIG. 5, the radial running groove is shown having a shape that in conjunction with the snap ring 32 allows the piston 20 to move in one direction but not the other. The shape of the groove is also arranged to release the piston for movement to its extended position in response to a relatively precise force being applied to the inner end 25 of the piston. In the direction in which the snap ring 32 allows movement, the snap ring 32 requires an activation or deploying force of a certain magnitude before it will permit the piston 20 to move. The magnitude of the activation or deploying force primarily depends on the spring constant of the snap ring 32, the relevant frictional forces between the snap ring 32 and the piston 20, and the shape of the piston groove 43. In particular, the piston groove 43 has a first vertical face 42 opposed by a second vertical face 45. An example is given herein as to dimensions for these parts of the retaining mechanism, which dimensions have been shown to work where the desired release pressure applied to end 25 of the piston is approximately 1,400 to 1,500 psi.

In the example, faces 42 and 45 are separated 0.090 inches when the snap ring 32 diameter is 0.07 inches. Thus the bottom surface of the groove 43 is a total of 0.090 inches and is comprised of a step portion 40 and a deep portion 46. The step portion 40 sits above the deep portion about 0.008 inches or about one fourth the total depth of the grove (face 45) which is about 0.034 inches. The total depth of the groove should be less than one half the diameter of the snap ring. The step 40 is about 0.030 inches long and extends along the bottom far enough to just let the snap ring seat on or touch the bottom of deep portion 46 of the groove.

In trying different configurations of grooves for this activation or retaining groove, whichever way it may be characterized, it was discovered that an upwardly sloped bottom surface 40 in the direction of snap ring movement would sometimes let the snap ring imbed in the softer metal of the groove. This would cause the release to take place usually at a higher pressure than desired, but the release was in the least, unpredictable. A next try involved using a straight wall 42 to total depth of the groove and a flat bottom surface 40, 46. This configuration led to a release pressure that was very dependent on the hardness of the metal forming an edge 47 between the face 42 and the outer cylindrical surface of piston 20 and the shape of the snap ring. The release of the snap ring 32 from the groove depended on the slight deformation of this edge 47 by the harder snap ring in order to start the upward movement of the snap ring from the groove 43. At pressures above about 800 psi this releasing force was being unpredictable.

A solution was discovered by using the configuration set forth in FIG. 5 wherein the stepped bottom surface increased the predictability to within about 10 percent at 1,400 psi. 1,000 psi gives more than an adequate margin to permit the casing pipe to be washed down in order to install the pipe in a borehole. The activation pressure of this latter configuration can be changed by adjusting the height of the stepped surface 40. The step starts the upward movement of the snap ring at a more predictable force. A lesser force is required to ride the ring over the top edge 48 of the stepped face between bottom surfaces 40 and 46. The shallower the face 42 and thus the higher the step 40, the less force is required to force the snap ring 32 out of the groove and onto the outer cylindrical surface of the piston 20, to permit the piston to slide within the expanded snap ring to its extended position.

When the travel of the piston reaches its one final extended position, the ring 32 will contract into the groove 41 to latch or lock the piston into its one predetermined fixed extended position. The piston groove 41 is shaped to latch the piston in place so that it will not be moved from this position by forces imposed on the structure in the wellbore. It is important that the piston remain in this extended mode. In this mode, the inner end 25 is substantially clear of the inner bore of casing pipe 60. The chamfered peripheral edge 28 at the distal end 27 of the piston 20 also pushes the snap ring 32 into the snap ring groove 33 when the piston 20 is installed into the central hole 31 in the button 30.

The button 30 further includes a sealing arrangement to provide a pressure tight seal between the piston 20 and the button 30. In particular, the button 30 includes two O-rings 36 and 37 which are positioned on either side of the snap ring 32 in O-ring grooves 34 and 35, respectively. The O-rings 36 and 37 seal against the exterior of the piston 20 to prevent fluids from passing through the central hole 31 in the button 30. The O-rings 36 and 37 must slide along the exterior of the piston 20 passing the piston grooves 41 and 43 while maintaining the pressure tight seal. Accordingly, it is a feature of the preferred embodiment that the spacing of the O-rings 36 and 37 is wider than each of the piston grooves 41, and 43 and spaced apart at a different spacing compared to the spacing of the piston grooves. Therefore, as the piston 20 moves through the central hole 31 from the retracted position to the extended position, one of the O-rings 36 and 37 is in sealing contact with the smooth exterior of the piston 20 while the other may be opposed to one of the piston grooves 41 and 43. Both O-rings 36 and 37 are never juxtaposed to the piston grooves 41 and 43 simultaneously but rather at least one O-ring is in sealing contact with the exterior of the piston 20 at all times. If a piston guide insert or button 30 is not used, the O-ring grooves 34 and 35 may be placed in a hole formed in thick wall pipe, casing collars, thick walled subs, or the like. Thus the hole and O-rings 36 and 37 serve as a piston guide.

The piston 20, as noted above, further includes an outwardly tapered peripheral edge 26 at the inner end 25 which serves as a stop against the button 30 to limit the outward movement of the piston 20. The button 30 includes a chamfered edge 39 for engaging the outwardly tapered peripheral edge 26 when the inner end 25 is approximately flush with the inner end of the button 30. Therefore, as arranged, the piston 20 is recessed into the button 30 and substantially clear of the interior bore of the casing 60. A slight dome shape to the inner end 25 of the piston plug 21 may extend slightly into the bore of casing 60, but for all practical purposes the casing bore is considered full opening when the piston is extended and locked.

As noted above, the centralizers 50 are initially provided in the retracted position so that the casing 60 can be run into the well W without the drag and interference of the centralizers 50 extending outwardly. The snap ring 32 is engaged with the running groove 43 to hold the piston in the retracted position until the piston is moved outwardly. As should be noted from the shape of the running groove 43, under normal conditions, the edge 47 of face 42 will not slide past the snap ring 32 and thus the piston is prevented from being moved inwardly into the casing 60 from the retracted position. An activating force (in the present example 1,400 psi) is required to be applied to the inner end 25 to override the snap ring retaining force. It is important that the piston 20 be retained in its running position, i.e., retracted into the casing string until a fairly precise activating force is applied to the inner end of the piston so that premature deployment will not occur due to any extraneous forces being generated within the casing bore. Additionally, it is important to know when piston deployment occurs so that the operator can be assured that upon application of a predetermined force to the inner end of the piston, activation to an extended position will occur.

Once the casing 60 is positioned in the wellbore W for permanent installation, the pistons 20 are deployed to the extended position. A deploying arrangement, as will be discussed below, provides a deploying force on the inner end 25 of each piston 20 to overcome the resistance of the snap ring 32 in running groove 43 and cause the square edge 47 of face 42 of the running groove 43 to push the snap ring 32 into the snap ring groove 33. The deploying force further moves the piston 20 outwardly through the central hole 31 so that the snap ring 32 engages the locking groove 41.

The interaction between the snap ring 32 and the groove 41 is to fully expand into the groove and permanently latch the piston in the extended position. If the distal end 27 of the piston 20 has contacted the wall of the wellbore W, the piston 20 will push the casing away from the wall of the wellbore W to centralize the casing 60.

As illustrated in FIGS. 2 and 3, the casing 60 and centralizers 50 are selected based on the size of the wellbore W so that the pistons 20 may fully extend to the extended position and thereby contact the walls of the borehole around most of the casing 60. Accordingly, during the deployment of the piston 20, the deploying force is expected to move the piston 20 to its fully extended position wherein the snap ring 32 will snap into latching groove 41. Groove 41 is slightly wider than the diameter of the snap ring to permit it to easily contract into the locking groove. The depth of groove 41 is such that the ring 32 will not expand outwardly under forces applied to the ends of the piston. More importantly, groove 41 does not have the stepped bottom as with groove 43 so that there is no shallow edge 48 to engage the snap ring and start it upward out of the groove 41.

At about the same time that the snap ring 32 engages the locking groove 41, the outwardly tapered edge 26 at the inner end 25 of the piston 20 engages the chamfered edge 39 of the button 30. Accordingly, once the snap ring 32 snaps into the locking groove 41, the piston 20 cannot extend outwardly farther and cannot be retracted. The locking groove 41 is provided with square edges at both sides to insure a locking action.

The centralizer 50 may be of different embodiments for different functions, in addition to the centralizing function described herein. In Applicant's copending U.S. application Ser. No. 761,210, now U.S. Pat. No. 5,228,518 embodiments of the centralizer are shown for a variety of functions such as chemical injection, perforating, fracturing and as a production conduit, or for use in combinations of these functions. Thus the bore 29 within the piston 20 may have a shaped charge or tracer material, or the end cap 21 may be made of a material such as aluminum which can be readily dissolved with acid.

Referring again to FIG. 1, an activating device 81 is shown in the casing pipe entering the horizontal section. This activating device is in the form of a pump down plug which has a tail portion with elastomeric seals 82 that engage the inner bore of the casing pipe string and form a seal. Thus the device 81 may be run down the pipe string by the application of hydraulic pressure or it may be run on a pipe string or coiled tubing. The front of the plug has a tapered nose portion 85 that tapers into the main body 83 which has an outer diameter just under the size of the casing pipe. The nose portion 85 of the plug 81 engages the inner end 25 of the centralizer piston. The enlarged body portion 83 forces the piston outwardly to override the retaining effect of the snap ring 32 to move the piston 20 to an extended position. When the snap ring 32 contracts into locking groove 41, the piston is fixed in a single predetermined extended position. In this position the inner end 25 of the piston is substantially clear of the casing bore except for the dome shaped aluminum end 25 on the plug 21 at the inner end of the piston which extends only a slight distance into the casing bore, say 0.14 inches. This end plug is easily deformed or crushed when the plug 81 passes the inner end of the piston. Any subsequent devices such as bridge plugs or packers can easily pass the inner end of the piston even though this slight portion (up to 0.14 inches) may be extended into the bore so that for all practical purposes the bore is considered full open when the piston is extended. Additionally, aluminum is soft enough that it can be easily knocked off if needed. Since the drilled hole size of the borehole is known, the length of the piston is selected to provide for adequate centralizing of the casing pipe in the hole. It is not necessary for the distal end of all pistons to be in contact with the borehole wall and from a practical standpoint it is likely that they will not all be so engaged. The casing will likely fall to one side of the borehole and the centralizer 50 on that side will engage the borehole wall and push the casing pipe string toward the center of the borehole.

The centralizers 50 may also be deployed by hydraulic pressure in the casing. Accordingly, the casing pressure may be pumped up at the surface closing a valve at the base of the casing string 60 and exceeding the activation or deploying force required to move the pistons from the retracted position to the extended position. Accordingly, the pumps or other pressure creating mechanism would provide the necessary deploying force for the pistons.

In operation and to review the invention, the casing 60 is to be run into a well. It is preferable to have the casing 60 centralized so that an annulus of cement can be injected and set around the entire periphery of the casing to seal the same from the formation. A series of centralizers 50 are installed into the casing 60 such that the pistons are in the retracted position. While in the retracted position, the centralizers 50 are within the maximum outer profile of the casing 60 so as not to interfere with the installation of the casing 60. The centralizers may be installed in certain portions of the casing or may be installed along the entire length thereof and arranged to project from all sides of the casing 60. However, certain centralizers 50 may be predesignated for certain functions. For example, from logging reports and other analysis, it may be decided not to try and produce a certain portion of the formation and the portion of the casing which is expected to coincide with the non-produced portion will be provided with plugs that are solid. In an adjacent zone, it might be desirable to perforate the formation with a series of explosive plugs or to establish communication with the formation without perforating the formation. Plugs having sacrificial material may be interspersed along the length of the casing 60. Thus centralizing pistons accommodating those various functions would be installed as shown in copending U.S. application Ser. No. 761,210, now U.S. Pat. No. 5,228,518.

The casing 60 is run into the hole to be located in a suitable place in the wellbore W. Without the conventional externally mounted centralizer equipment, the casing 60 may be rotated and reciprocated to work past tight spots or other interference in the hole. The centralizers 50 further do not interfere with the fluid path through the casing string so that the casing may be circulated to clear cuttings from the end of the casing string. Also the casing could be provided with fluids that are less dense than the remaining wellbore fluids, such as drilling mud, causing the string to float. Clearly, the centralizers 50 of the present invention permit a variety of methods for installing the casing into the desired location in the wellbore W.

Once the casing 60 is in a suitable position, the centralizers are deployed to centralize the casing. It is important that deployment of the piston be controlled accurately so that it will be known with some assurance that a particular force will be required to initiate movement of the centralizers to an extended position. The predetermined force required for such deployment is provided by the retaining groove and latching arrangement shown in FIG. 5. As discussed above, there are several methods of deploying the centralizers. The casing may be pressured up by pumps to provide the adequate hydraulic force necessary to deploy the pistons. The pistons may not all deploy at once but as the last ones deploy the casing will be moved away from the wall of the wellbore W. Alternatively, a device 81 such as is shown in FIG. 1 may be used to deploy the pistons. The casing in this latter mode of operation would be centralized from the top to bottom. Once the pistons are all deployed and the snap rings have secured them in the extended position such that the pistons are projecting outwardly toward the wall of the wellbore, cement may be injected into the annulus formed by the centralizing of the casing.

The casing 60 may be allowed to set while the production string is assembled and installed into the casing. It is important to note that at this point in the process of establishing the well that the casing and wellbore are sealed from the formation. Accordingly, there is as yet no problem with controlling the pressure of the formation and loss of pressure control fluids into the formation. In a conventional completion process, a perforation string is assembled to create perforations in the casing adjacent the hydrocarbon bearing zone. Accordingly, high density fluids are provided into the wellbore to maintain a sufficient pressure head to avoid a blowout situation. While the production string is assembled and run into the well, some of the fluids will leak into the formation. Unless replacement fluids are provided into the well, the pressure head will decrease until the well becomes unstable. Accordingly, the production string must be installed quickly to begin producing the well once the well has been perforated.

However, with the present invention, such problems are avoided. Once the casing is set in place, the production string may be assembled and installed before the plugs are destroyed. Thus, the process of establishing a well further includes the step of destroying the plugs by acid or by rupturing under pressure or by other means as discussed above.

It should be recognized that this invention has been described for casing in a wellbore for the production of hydrocarbons, which in itself includes many applications. For example, some wells are created for pumping stripping fluids down into the formation to move the oil toward another well which actually produces the oil. Also, the centralized pipe may be run into a larger pipe already set in the ground. For example, on an offshore drilling and production rig, a riser pipe is installed between the platform and the well head at the sea floor. Within the riser pipe other pipes are run which are preferably centralized. The centralizers 50 of the present invention may provide a suitable arrangement for such applications. There are other applications for this centralizing invention which have not been discussed but would be within the scope and spirit of the invention. Accordingly, it should be recognized that the foregoing description and drawings are illustrative of the invention and are provided for explanation and understanding. The scope of the invention should not be limited by the foregoing description and drawings but should be determined by the claims that follow.

We claim:

1. An apparatus positioned in the wall of a pipe for use in a wellbore to centralize the pipe in the wellbore wherein guide means in the wall of the pipe has an elongated piston mounted therein for movement from a retracted position within the outer profile of the pipe to an extended position wherein the piston extends outwardly from the wall of the pipe, and latch means are arranged for maintaining the piston in a retracted position while the pipe is being run into the wellbore, the latch means comprising;

a substantially cylindrical guide surface formed transversely in the wall of the pipe;

an annular guide groove formed in the wall of the pipe around the guide surface in a plane perpendicular to a longitudinal axis of the guide surface;

an annular piston groove in an outer wall of the piston, said piston groove being in a plane perpendicular to the longitudinal axis of the piston;

snap ring means mounted in said piston groove and arranged to expand outwardly over the outer surface of said piston into said guide groove when a force is applied to one end of said piston and thereby permit said piston to move from said retracted to said extended position for centralizing the pipe in the wellbore.

2. The apparatus of claim 1 wherein said annular piston groove is formed in the shape of a ring shaped channel having substantially straight side walls spaced from one another and extending inwardly into the outer surface of the piston and a stepped bottom surface extending between the side walls, which bottom surface is parallel to the outer cylindrical surface of the piston.

3. The apparatus of claim 2 wherein said snap ring is substantially circular in cross-section and the stepped bottom surface of the piston groove has a first wider portion that is no deeper into the surface of the piston than 0.5 times the diameter of the snap ring.

4. The apparatus of claim 3 wherein the first wider portion is sized to permit said snap ring to engage the bottom surface when said piston is in said retracted position.

5. The apparatus of claim 3 wherein said first wider portion is less wide than the diameter of the snap ring.

6. The apparatus of claim 3 wherein the stepped bottom surface has a second less wide portion that is no more wide than 0.33 times the total width of the stepped bottom surface.

7. The apparatus of claim 1 wherein said pipe is comprised of a casing pipe string and said piston when extended serves to move the casing pipe string toward the center of the wellbore.

8. The apparatus of claim 7 and further including an annular locking groove formed in the outer wall of the piston for receiving said snap ring when said piston has moved to said extended position and for fixedly holding said piston in said extended position.

9. The apparatus of claim 8 wherein said locking groove is configured to receive said snap ring so that continued forces applied to said piston will not permit further movement of said piston relative to said guide means.

10. Apparatus for spacing a casing pipe string from the walls of a borehole comprising;

a plurality of annular side wall guide openings in the casing pipe string;

a piston having a unitary piston body mounted for lateral sliding movement in the guide openings between a retained position and an outwardly extended locked position wherein the outer end of the piston is arranged to extend into contact with the wall of the borehole;

latch means for holding said piston in said retained position including a first annular groove formed in the outer circumferential wall of said piston, a second annular groove formed in the inner circumferential wall of said side wall guide openings, and expandable ring means positioned in said first and second grooves when said piston is in said retained position.

11. The apparatus of claim 10 wherein the casing pipe string is made up of sections of casing pipe connected by collars greater in diameter than the casing pipe and providing a maximum exterior profile of the casing pipe string and wherein the outermost portion of said guide opening and the outer end of said piston present a profile that is less than the maximum exterior profile of the casing pipe string when said piston is in said retained position for running said casing pipe string into the borehole.

12. The apparatus of claim 10 wherein the inner end of said pistons is substantially clear of the inner bore of said casing pipe string when said piston is in said extended position.

13. Apparatus for spacing a casing pipe string from the walls of a borehole comprising;

a plurality of annular side wall guide openings in the casing pipe string;

a piston mounted for lateral sliding movement in the guide openings between a retained position and an outwardly extended locked position;

latch means for holding said piston in said retained position including a first annular groove formed in the outer circumferential wall of said piston, a second annular groove formed in the inner circumferential wall of said side wall guide openings, and expandable ring means positioned in said first and second grooves when said piston is in said retained position, wherein said ring is expandable upon the application of predetermined force to one end of said piston for movement of said ring into said second annular groove to expand about the outer surface of said piston to permit said piston to move to said extended position.

14. The apparatus of claim 13 wherein said latch means is arranged to prevent movement of said piston in a direction opposite of its movement to said extended position.

15. The apparatus of claim 14 wherein said first groove has a stepped surface at the bottom of said groove, the depth of said stepped surface being determinative of the force necessary to expand said ring over the outer surface of said piston.

16. Apparatus for spacing a casing pipe string from the walls of a borehole comprising;

a plurality of annular side wall guide openings in the casing pipe string;

a piston mounted for lateral sliding movement in the guide openings between a retained position and an outwardly extended locked position, wherein said piston can move to only a single predetermined extended position to space the casing pipe string from the walls of the borehole; and latch means for holding said piston in said retained position including a first annular groove formed in the outer circumferential wall of said piston, a second annular groove formed in the inner circumferential wall of said side wall guide openings, and expandable ring means positioned in said first and second grooves when said piston is in said retained position.

17. The apparatus of claim 16 and further including a third annular groove which is formed in the outer wall of said piston for engaging said expandable ring when said piston is moved to said extended position to lock said piston in said extended position.

* * * * *